US005344333A

United States Patent [19]

Haag

[11] Patent Number: 5,344,333

[45] Date of Patent: Sep. 6, 1994

[54] LOCKING APPARATUS FOR ELECTRICAL PLUG CONNECTOR ASSEMBLIES

[76] Inventor: Philip E. Haag, 523 Keelson Cir., Redwood City, Calif. 94063

[21] Appl. No.: 933,486

[22] Filed: Aug. 21, 1992

[51] Int. Cl.[5] ..... H01R 13/62

[52] U.S. Cl. ..... 439/320; 439/312; 439/106

[58] Field of Search ..... 439/320, 321, 322, 323, 439/312, 313, 106, 373; 411/437, 436, 427

[56] References Cited

U.S. PATENT DOCUMENTS

| | | | |
|---|---|---|---|
| 839,224 | 12/1906 | Stokes | 439/320 |
| 2,517,364 | 8/1950 | Torresen | 411/437 |
| 3,461,417 | 8/1969 | Schumacher et al. | 439/106 |
| 3,605,059 | 9/1991 | Lipinski | 339/14 L |
| 3,742,427 | 6/1973 | Ballard | 439/320 |
| 3,891,289 | 6/1975 | Hanke | 339/14 P |
| 4,318,578 | 3/1982 | Ericson et al. | 439/106 |
| 5,087,209 | 2/1992 | Faucher | 439/320 |

*Primary Examiner*—Larry I. Schwartz
*Assistant Examiner*—Hien D. Vu
*Attorney, Agent, or Firm*—Thomas C. Feix

[57] ABSTRACT

A locking apparatus for a standard two or three prong electrical plug connector assembly which includes a retro-fit face plate for attachment to the male plug end of the electrical connector assembly and a rotatable sleeve housing for jacketing a portion of the female socket end of the electrical connector assembly. The face plate includes a plurality of male threads provided along an outer perimeter edge thereof which threadingly engage a coordinate plurality of grooves provided to an inner wall of the sleeve housing adjacent a male plug receiving end to twist lock the two connector ends together. The sleeve housing also includes a radially inward extending notched key way at its other end which is received within a receiving slot provided to the outer periphery of the electrical outlet insulator body and which cooperates with a stop member provided to the outlet insulator body to limit lateral (rotational) travel of the sleeve housing about the outlet insulator body. In an alternate embodiment, a shortened rotatable sleeve housing is adapted for snap fit insertion within a wall-mounted electrical outlet cover plate for twist locking a male plug connector end thereto.

7 Claims, 2 Drawing Sheets

LOCKING APPARATUS FOR ELECTRICAL PLUG CONNECTOR ASSEMBLIES

BACKGROUND OF THE INVENTION

1. Field of the Invention

The invention relates generally to electrical connector assemblies and more particularly to a twist lock housing and face plate attachment for electrical connector assemblies of the conventional two and three prong type for preventing inadvertent separation of two mating connector ends when plugged together or inadvertent disconnection of a single male connector plug end from a receiving wall socket.

2. Brief Description of the Prior Art

In the area of electrical plug connectors, such as for example, the common two-prong or three-prong type electrical plug connectors, it is desirable to ensure that the male plug end remains connected to the female receiving socket end of an extension cord or to a receiving wall socket during use. From U.S. Pat. No. 3,891,289 issued to Hanke, a lockable electrical outlet is described wherein the electrical outlet is provided with a rotatable locking pin having a camming surface thereon and which is operative to individually close a pair of electrical contact assemblies to ensure a positive engagement with the corresponding blade contacts of an inserted male plug assembly.

A disadvantage with the rotatable locking pin arrangement of Hanke is that a finger-actuated lever portion of the rotatable locking pin member protrudes outwardly from the electrical outlet housing and, thus exposed, the lever tends to snag or hang up on fixtures or other immobile objects during use. This becomes a major inconvenience, such as for example, when a user of a power tool yanks or pulls on the extension cord and the connector assembly becomes stuck on some fixture. A stuck connector assembly means that the user must stop work and go to the site of the plug connector hang up and fix the obstruction problem. Otherwise, continued pulling on the cord may inadvertently move the exposed lever to the open position thus releasing the plug from engagement; here again, requiring the user to stop work and go to the problem area to reconnect the connector assembly and adjust the cord in an attempt to avoid further entanglements.

In the construction industry, use of extension cords for connecting power tools to a power source is wide spread. Also, the nature of the work may require moving the extension cord several times during a job, thus giving rise to the possibility that the cord will snag on stationary objects or fixtures.

Inadvertent disconnection of extension cords account for a majority of interruptions on the job. Also, locking designs of prior art electrical connectors of the type described above have not proved popular in view of the added costs and complexity associated with parts and labor in manufacture of the female socket end.

Accordingly, there is a definite need in the art for an improved low cost electrical plug locking assembly which may be implemented in an extension cord or a wall mounted outlet and which overcomes the problems of the prior art.

SUMMARY OF THE INVENTION

Objects of the Invention

It is an object of the invention to provide a simple two-piece twist lock assembly for electrical connectors including a housing which rotatably jackets the female plug end or socket portion of the electrical connector and a face plate which attaches to the male plug end of the electrical connector and wherein the two assembly pieces include mating twist lock surfaces which, when engaged, prevent inadvertent separation of the electrical connector assembly.

It is another object of the present invention to provide a twist lock assembly for electrical connectors which is simple and inexpensive to manufacture and is easy to implement with existing standard two and three prong electrical connectors.

It is another object of the present invention to provide a twist lock assembly for electrical connectors of the type described wherein the female receiving socket rotatable outer housing may be embodied in a wall mounted outlet.

It is still yet another object of the present invention to provide a twist lock assembly for electrical connectors which includes a pair of cone shaped outer housing portions both of which are smoothly tapered at their extension cord receiving ends to substantially minimize snagging or catching of the locking electrical connector on fixtures or other immobile objects in the work place when the electrical connector is being moved by an operator or user through a pulling action on one end of the extension cord.

Briefly, a preferred embodiment of the present invention comprises a two piece locking apparatus for a standard two or three prong electrical plug connector assembly including a retro-fit face plate for attachment to the male plug end of the electrical connector assembly and a rotatable cylindrical outer sleeve housing for jacketing a portion of the female socket. The face plate includes a plurality of male threads provided along an outer perimeter edge thereof. The cylindrical outer sleeve housing includes a plurality of female grooves provided along an inner peripheral housing wall adjacent one end for engaging male threads of the face plate such that rotation of the outer housing in one direction advances the cylindrical outer housing onto the male threads of the face plate and locks the electrical plug assembly together.

The cylindrical outer housing also includes a radially inward extending notched key way at its other end which is adapted to travel both laterally and longitudinally within a receiving slot or groove provided to the outer periphery of the electrical outlet insulator body. The notched key way also cooperates with a stop member provided to the outlet insulator body to limit lateral (rotational) travel of the outer cylindrical housing about the outlet insulator body.

Each male thread of the face plate and the corresponding receiving grooves of the cylindrical outer sleeve housing include a slight terminal end camber region to ensure a tight twist lock fit between the two pieces and to prevent inadvertent backing off of the outer housing when either one or both plug connector ends experience a tension force. Matching conically shaped end housings may be provided at the cord ends of each plug and receptacle body portions such that a continuously smooth and tapered housing surface for the connected electrical plug connector assembly is achieved.

In an alternate embodiment, the generally cylindrical rotatable outer housing is cut down in length and adapted for use with a wall-mounted electrical outlet cover plate. The cover plate includes two openings which permit access to the wall sockets, each hole having at least one keying member protruding into the opening. The wall socket facing end of the modified outer housing has a stepped thickness region and includes a protruded rib member or engaging lip for snap fit insertion within receiving holes in the outlet cover plate. One or more longitudinal slit-like perforations may be provided to the wall socket facing end to facilitate the snap fit insertion into the cover plate. Female grooves are provided at the outward facing male plug receiving end of the outer housing which, as before, engage the male threads provided to the outer perimeter edge of the male plug end face plate.

In operation the two or three prong plug connector end having the provided face plate with male threads is inserted in the wall socket such that the prongs engage the coordinate receiving holes of the wall socket in the normal way after which the outer cylindrical housing is then rotated counterclockwise thereby advancing its grooves along the male threads on the face plate perimeter edge thus locking the plug to the wall socket in twist lock fashion. In both embodiments the outer cylindrical housing preferably has a serrated or knurled surface to facilitate handling by a user.

Features and Advantages of the Invention

An advantage afforded by the present invention is the extended operating life and reliability of the electrical contacting components of the electrical plug connector assembly since the twist lock feature of the locking apparatus substantially limits tensional forces on the electrical plug connector assembly and thereby prevents excess wear of the electrical contact surfaces of the receptacle and plug ends.

Other features and advantages of the present invention will become evident from the following detailed description, drawings and appended claims.

IN THE DRAWING

The invention is more clearly understood with reference to the drawings in which.

DETAILED DESCRIPTION OF THE PREFERRED EMBODIMENT

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
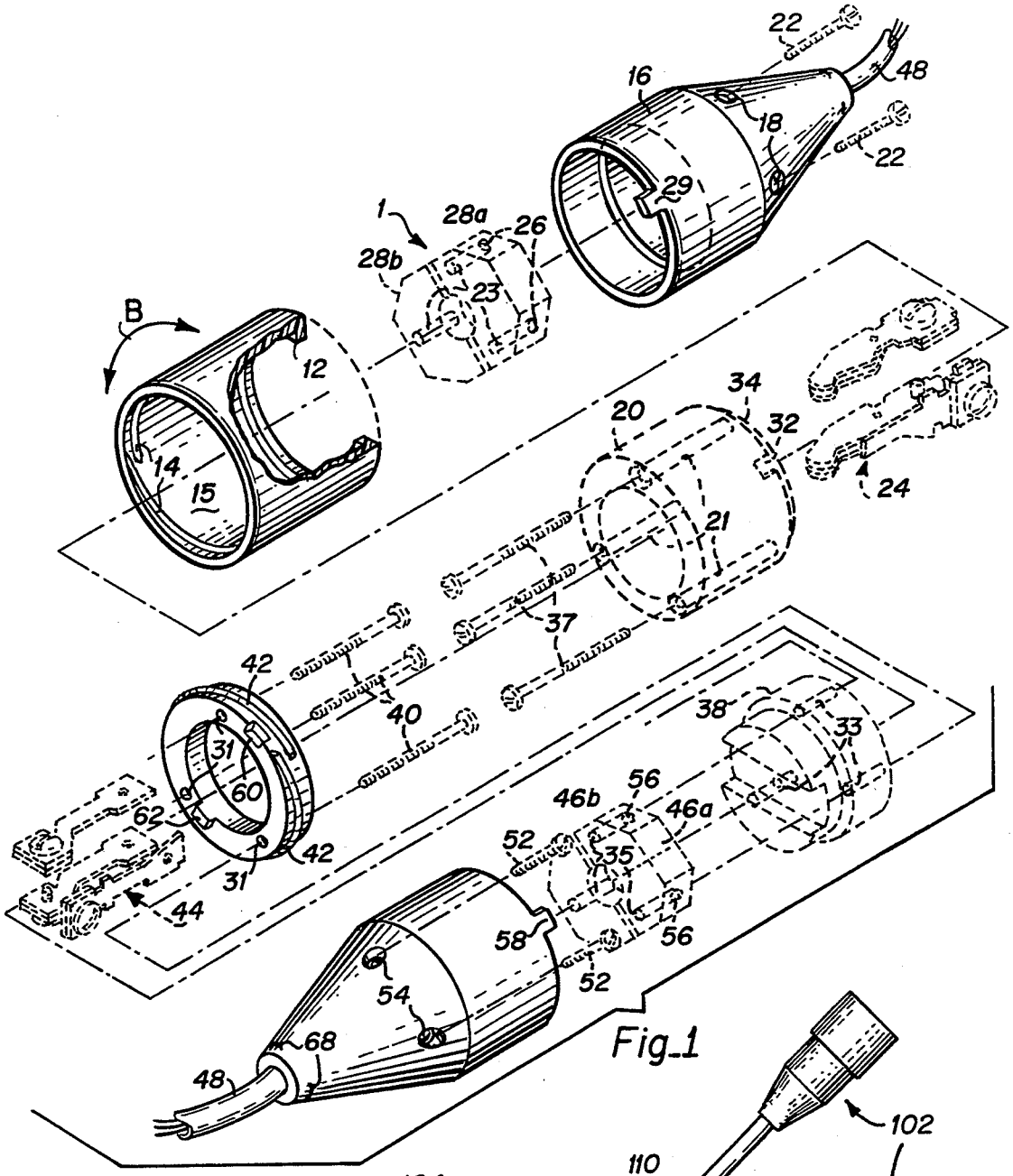
FIG. 1 is an exploded isometric view of a preferred embodiment of the present invention.

With reference to FIGS. 1–2, a locking electrical plug assembly constructed in accordance with a preferred embodiment of a present invention is shown and generally indicated by the referenced numeral 1.

In general, the invention comprises injected molded plastic parts which either fit around or are attached to the female and male plug ends of a standard electrical connector assembly and function to twist lock the two connector ends together. While the standard electrical connector assembly shown in the drawings is representative of a standard commercial grade (OSHA approved) twist lock, 125 volt, 20 amp three prong assembly, it is understood that the connector type implementation for the invention is not so limited and that the locking elements and housing components to be described below are easily and readily adaptable for use with most, if not all, commercially available two and three prong electrical connector assemblies. For the following description, all standard connector assembly components are indicated in phantom.

In the embodiment shown, the female portion 2 of the electrical connector assembly 1 includes the outlet insulator body 20, electrical contact assemblies 24 (only two of which are shown for clarity) and end cap portions 28*a* and 28*b*. Machine screws 37 and associated fastening hardware (not shown) are used to connect together the insulator body 20, electrical contact assemblies 24 and end caps 28*a* and 28*b* of the female plug portion 2 by threaded engagement within the respective coaligned threaded holes 21 and 23 of the insulator body 20 and end caps 28*a* and 28*b* in the known way. A first locking portion of the invention comprises a substantially cylindrical outer sleeve or housing member 10 and conical housing member 16, both of which enclose the interior portion of the female portion 2 (see FIG. 2) of the electrical plug connector assembly 1. The female plug end conical housing 16 preferably includes one or more holes 18 for receiving machine screws 22 which are receivingly engaged by 13 coordinately aligned threaded bore holes 26 provided in the end cap portions 28*a*, 28*b* for securing the conical housing 16 to the interior portion of the female portion 2 of the electrical connector assembly.

The conical housing 16 is formed with an extended tab member 29 adapted for key fit insertion within a receiving slot 32 formed in the outlet insulator body 20. The length of the tab member 29 is slightly longer than the depth of the slot 32, which results in the formation of a gap 36 between the conical housing 16 and the outlet insulator body 20 when connected together as above described.

The cylindrical outer sleeve or housing 10 includes a notched key way 12 at one end, which is disposed to fit within the gap 36. The thickness of the notched key way 12 is slightly less than the width dimension of gap 36 to permit a slight fore-aft or longitudinal movement of the conical housing 16 within the gap as indicated by directional arrow A (See FIG. 2A). The outer surface of the sleeve or housing 10 is preferably knurled or serrated to facilitate handling by a user.

The notched key way 12 preferably extends only part way around the perimeter inner wall of the cylindrical housing 16 before abutting against the key or extended tab member 29 to permit a limited arcuate range of movement or twist rotation of the cylindrical outer housing 10 about the outlet insulator body 20. This rotational motion is indicated by directional arrow B in the drawings. At its other prong receiving end, the cylindrical outer housing or sleeve 10 includes at least one, and preferably a plurality of, spiral female groove(s) 14 formed along its inner peripheral wall 15.

Referring now to the male plug portion 4 of the connector assembly 1, a face plate 30 is attached to the plug insulator body 38 by machine screws 40 which are received within coaligned through-holes 31 of the face plate 30 and the respective threaded holes 33 and 35 of the insulator plug 38 and end caps **46*a* and 46*b* in the known way. The face plate 30 is identical in size and shape to a standard face plate for which it is designed to replace except for the inclusion of at least one, and preferably a plurality of, male screw thread(s) 42 disposed along its outer perimeter edge. For locking operation, the female grooves 14 of the cylindrical outer housing 10 engage and advance along corresponding threads 42 upon rotation of the housing 10 thus securing the two plug portions 2 and 4** together in twist lock fashion.

In a preferred embodiment the male threads 42 are standard four (4) point threads of the cross hair type wherein each individual thread has a terminal end portion 42 defined as a 2° camber of approximately 0.125 inches in length. This cambered terminal edge portion 42 prevents inadvertent backing off of the cylindrical sleeve or housing 10 (i.e., a reverse or counterclockwise rotation of the sleeve or housing 10) when a tension force is exerted on the electrical connector assembly such as might otherwise occur, for example, when a user tugs or pulls on one end of either power cords 48.

The plug insulator body 38 houses the blade contacts (indicated generally at 44) of the male plug portion 4 in the known way. The male plug portion 4 also includes end body portions **46*a*, 46*b* or similar structure for completing the male plug portion assembly and the proper connection to the insulated wire cord 48**.

As described above in connection with the female plug portion 2, a second conical housing 50 may be provided for enclosing the internal standard components of the male plug portion 4. As before, machine screws 52 are inserted through holes 54 provided in the conical housing 50 for threaded engagement with the coordinately aligned threaded bore holes 56 of the end body portions **46*a*, 46*b*. Conical housing 50 preferably includes at least one extended tab member 58 for engaging a receiving slot 60 provided in the face plate 30**.

As is best seen in FIG. 1, face plate 30 may also include a male extended tab member 62 which engages a coordinately aligned receiving slot (not shown) in the opening receiving edge of the conical housing 50. This arrangement for tabs and receiving slots on the conical housing 50 and face plate 30 provides a means for insuring the proper orientation and alignment of the face plate 30 with its male threads 42 with respect to the plug insulator body 38 such that the screw threads 42 will engage the grooves 14 of the sleeve 10.

Figure 2A:
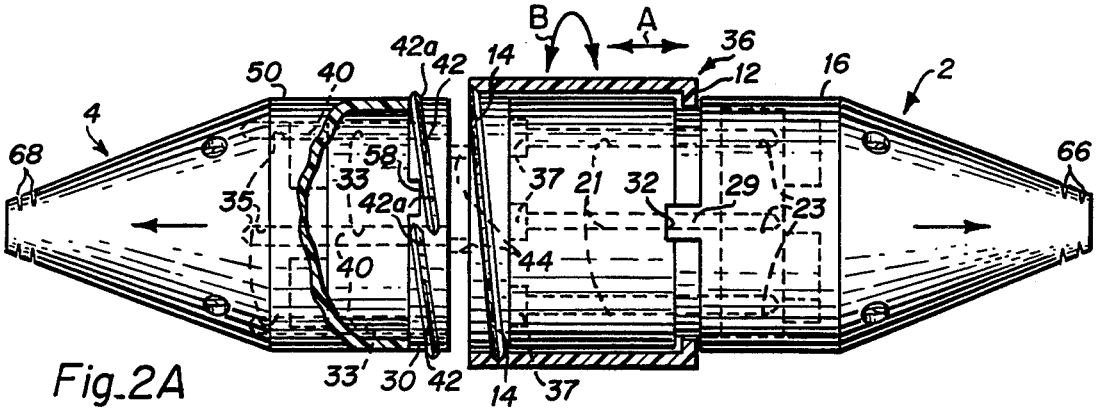
FIG. 2A is a side elevation view in partial cross-section showing a first "unlocked" position of the invention.
Figure 2B:
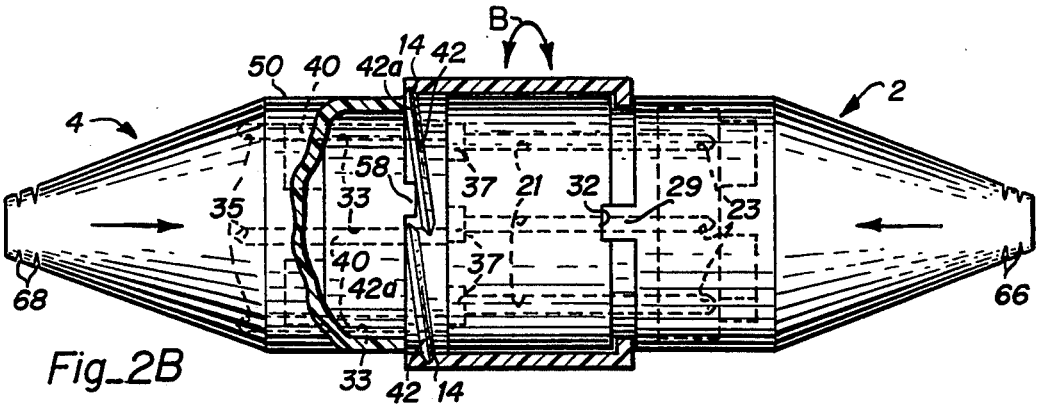
FIG. 2B is a side elevation view in partial cross-section similar to FIG. 2A showing a second "locked" position for the invention.

With reference now particularly to FIGS. 1, 2A and 2B the twist locking operation of the invention will be described. For twist lock connection of the two plug end portions 2, 4, the blade assemblies or prongs 44 of the male plug end 4 are aligned 14 coordinate with the receiving electrical connector assemblies 24 of the receiving outlet portion 2 and the prongs 44 are inserted within the receiving electrical assemblies 24 in the usual way. In this position, the female grooves 14 of the cylindrical outer housing or sleeve 10 line up with the male threads 42 of the face plate 30. A clockwise rotation of the cylindrical outer housing/sleeve 10 in the direction of arrow B advances the grooves 14 onto threads 42 of the face plate 30 and advances the cylindrical housing 10 forward in the longitudinal direction of arrow A. The rotation of the housing 10 is limited by the abutting engagement of the notched key member 12 with the extended tab 29 of the conical housing 16. The gap 36 is sufficiently wide to permit a small degree of fore-aft movement or play of the notched key way 12 within the gap 36. The preferred gap dimension is sufficiently wide to permit the housing 10 to advance onto the face plate 30 to ensure full threaded engagement between grooves 14 and the threads 42.

The conical housings 16 and 50 are smoothly tapered at their respective power or extension cord receiving ends and thus substantially limit snagging or hang-up of the locking electrical plug assembly on fixtures or other immobile objects when the locking electrical plug assembly is pulled from either direction. Each housing also preferably includes one or more circumferential score lines 66, 68 at their respective tapered ends which, when cut away, provide a larger diameter hole to facilitate larger diameter power cords.

Figure 3A:
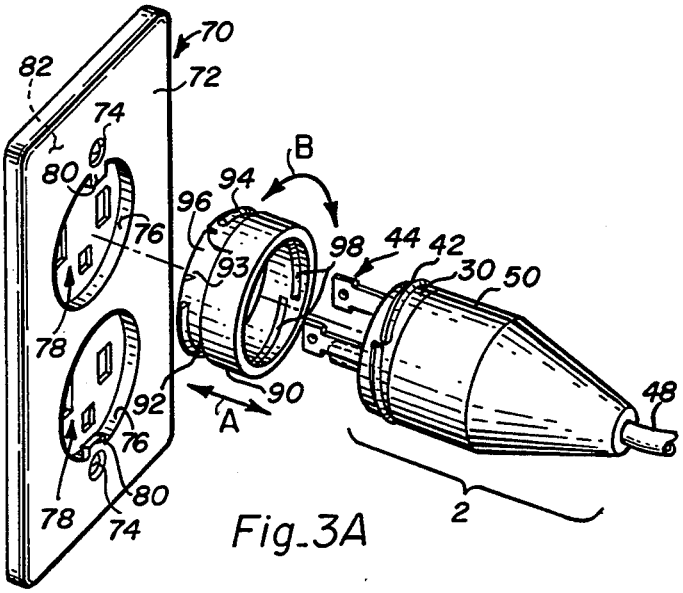
FIG. 3A is an exploded isometric view showing a first alternate embodiment of the invention adapted for use in a conventional wall socket.
Figure 3B:
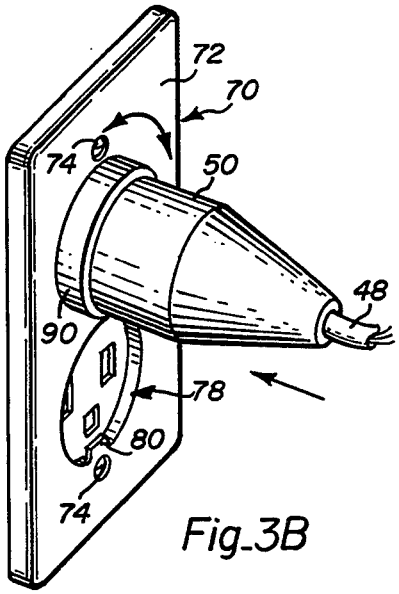
FIG. 3B is an isometric view of the alternate embodiment FIG. 3A showing the invention fully engaged in a twist lock position.

With reference now to FIGS. 3A–3B, a second embodiment of the invention is shown. In this embodiment a housing 90 is provided for twist locking the male portion 4 of the electrical plug assembly to a modified wall socket cover plate 72 of an electrical outlet 70. The modified cover plate 72 is used in place of the conventional outlet face plate and is secured to the existing top and bottom screw holes which secure the standard three-prong dual receiving socket electrical outlet. For this purpose, a pair of screws 74 are provided for threadingly engaging the existing top and bottom screw fixtures in the standard wall electrical outlet assembly 70. The cover plate 72 includes two generally circular holes 76 which provide access to the 3-prong wall sockets 78. Each hole 76 further includes a notched key member or tab 80. A generally cylindrical outer housing 90 may be provided for snap fit insertion within each hole 76.

The housing 90 is similar to the outer housing 10 of the principle embodiment in overall function and shape (except that it is shorter in length) and further includes a stepped relief portion 92 having an outer diameter sized to fit within hole(s) 76. One or more slit-like perforations 93 may be provided in the step portion 92 to facilitate snap fit insertion of the housing 90 within hole(s) 76. More perforations 93 are desirable when the housing 90 is fabricated from a hard plastic or if the wall thickness of the step relief portion 92 is unusually thick.

The stepped relief portion 92 is further defined by an upraised or protruding perimeter rib member or lip 94 which abuts against the inner back surface of the cover plate 72 when the housing 90 is inserted within the hole 76 to hold the cylindrical outer housing 90 in snap fit engagement with the cover plate 72. The upraised perimeter rib member 94 defines a clearance gap 96 sized for limited rotational travel of the housing 90 relative to the notched key member or tab 80 as indicated by arrow B in FIG. 3B. The perimeter rib 94 also defines a notched key way or gap distance in the step portion 92 to permit a small degree of reciprocating movement of the cylindrical outer housing 90 with respect to the cover plate 72. This reciprocating movement is indicated by directional arrow A in FIG. 3A.

As before with the first embodiment, female spiral grooves 98 are formed along an inner peripheral wall of the outer plug receiving end of the cylindrical outer housing 90 for engagement with the male threads 42 of the face plate 30. Indeed the housing elements for the male plug assembly are identical to those described above with reference to FIGS. 1 through 2. As before with reference to the first embodiment, the outer surface of the housing or sleeve 90 is preferably knurled or serrated to facilitate handling by a user.

In operation, the blades or prongs 44 of the male plug portion 4 are inserted within the receiving holes of an outlet 78 whereby rotation of the outer cylindrical housing 90 in the clockwise direction (or counterclockwise direction if a left hand or reverse thread scheme is used) of arrow B advances the grooves 98 onto threads 42 thus twist-locking the electrical plug connector to the wall outlet assembly 70. The cover plate 72 preferably has a depth dimension (i.e., distance spacing of the front face with respect to the wall) sufficient to permit the reciprocating travel of the cylindrical outer housing member 90 in a direction of arrow A.

Figure 4:
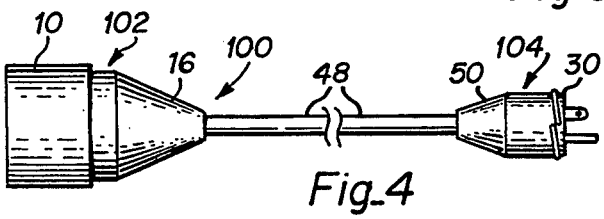
FIG. 4 is a second alternate embodiment showing the two-piece locking assembly implemented in a two prong-three prong adapter extension cord.

FIG. 4 shows a second alternate embodiment for an adaptor extension cord 100. The adaptor extension cord 100 connects a female plug end portion 102 of one type to a male plug end portion 104 of a second type. For example, the female plug end portion 102 may comprise a receptacle for a standard three-prong 125 volt 15 amp type connector wherein the male plug end portion 104 may comprise a standard commercial grade twist lock 125 volt 20 amp plug connector or even a standard two-prong plug end as shown. As before, the locking assembly elements of the male plug connector 104 may also include the conical housing 50 and the threaded face plate 30 while the female connector end portion 102 includes the conical housing 16 and the rotatable cylindrical outer housing 10. However, it is understood that the conical end housings are not necessary to achieve the twist locking as part of the invention.

Figure 5:
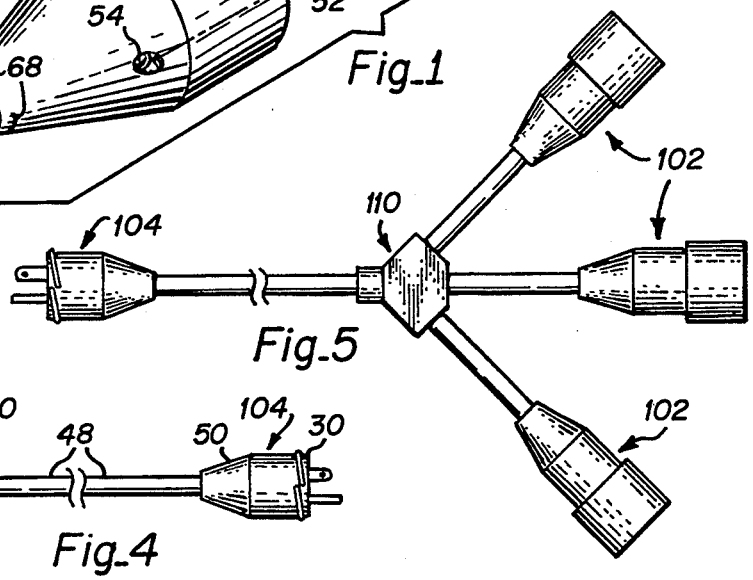
FIG. 5 shows another alternate embodiment of the invention implemented in the plug connector and receiving connector as a three-prong splitter electrical cord.

FIG. 5 shows yet another alternate embodiment of the invention wherein a three-prong splitter cable 110 is shown connecting a male plug end portion 104 to three female plug end portions 102. It will appreciated by those skilled on the art that numerous variations of the locking electrical plug assembly may be employed with existing standard two and three prong electrical connector assemblies. For purposes of brevity and clarity, only a few preferred embodiments of the invention have been described in detail.

It should also be understood that various other modifications within the scope of this invention can be made by one of ordinary skill in the art without departing from the spirit thereof. I therefore wish my invention to be defined by the scope of the appended claims as broadly as the prior art will permit, and in view of the specification if need be.

What is claimed is:

1. A locking apparatus for securing together a male plug end and a female plug end of an electrical connector assembly comprising in operative combination:

a) a face plate for attachment to a prong end of an insulator body of the male plug end;

b) a sleeve for enclosing an insulator body of the female plug end, said sleeve including a first sleeve end and a second sleeve end, said second sleeve end being rotatably connected to said female insulator body;

c) means for limiting said rotational connection of said sleeve with respect to said female insulator body; and wherein said means for limiting said rotational connection includes:

i) a notched key member provided to said sleeve second end;

ii) a circumferential gap formed within said female insulator body;

iii) said gap having at least one transverse stop member for limiting a range of rotational travel of said notched key member within said circumferential gap; and d) means for locking engagement of said first sleeve end to said face plate upon twist rotation of said sleeve when said male plug end is connected to said female plug end, and wherein said means for locking engagement comprises:

i) a plurality of discontinuous threads provided along a perimeter edge of said face plate; and ii) a plurality of discontinuous grooves provided along an interior surface of said sleeve first end and sized for snug fit receiving engagement of said plurality of discontinuous threads.

2. A locking apparatus or electrical connector assemblies as in claim 1 wherein each of said threads of said means for locking engagement includes a cambered terminal edge portion to prevent backing off of said grooves from said threads when said male and female plug ends of said electrical connector assembly undergoes tension.

3. A locking apparatus for electrical connector assemblies as in claim 2, further including:

a) a first conical housing provided to an electrical cord receiving end of said male plug insulator body;

b) a second conical housing provided to an electrical cord receiving end of said female receiving socket insulator body;

c) each of said first and second conical housings being smoothly tapered in a direction towards their respective electrical cord receiving ends to substantially minimize hang up and snagging of said electrical connector assembly on fixtures and other immobile objects.

4. A locking apparatus for electrical connector assemblies as in claim 3 wherein each of said first and second conical housings include at least one score line at an electrical cord receiving end to accommodate larger diameter electrical cords.

5. A locking apparatus for electrical connector assemblies as in claim 1 wherein said sleeve is serrated along an outer surface thereof to facilitate handling by a user.

6. A locking apparatus for electrical connector assemblies as in claim 3 wherein said sleeve is serrated along an outer surface thereof to facilitate handling by a user.

7. A locking apparatus for electrical connector assemblies as in claim 1 which includes means for aligning said face plate with respect to said male plug insulator body.

* * * * *